United States Patent [19]

Schapper

[11] 4,373,638

[45] Feb. 15, 1983

[54] SORTING APPARATUS

[75] Inventor: Mark A. Schapper, Ivanhoe, Australia

[73] Assignee: Sphere Investments Limited, Nassau, The Bahamas

[21] Appl. No.: 222,070

[22] Filed: Jan. 2, 1981

[30] Foreign Application Priority Data

Jan. 24, 1980 [ZA] South Africa ..... 80/0429

[51] Int. Cl.[3] ..... B07C 5/00; B07C 5/344

[52] U.S. Cl. ..... 209/570; 209/571; 209/587; 209/589; 209/639; 209/642; 209/914; 209/920; 209/934; 209/903; 209/908; 271/274

[58] Field of Search ..... 209/570, 571, 587, 589, 209/580, 581, 582, 638, 639, 642, 914, 920, 576, 934, 903, 908; 271/274

[56] References Cited

U.S. PATENT DOCUMENTS

| | | | |
|---|---|---|---|
| 753,592 | 3/1904 | Langerfeld | 209/934 X |
| 3,216,567 | 11/1965 | Kelly et al. | 209/639 X |
| 3,327,847 | 6/1967 | Lockshaw | 209/587 X |
| 3,977,526 | 8/1976 | Gordon et al. | 209/639 X |
| 4,252,240 | 2/1981 | Satake | 209/639 X |

*Primary Examiner*—Allan N. Knowles

*Attorney, Agent, or Firm*—Cushman, Darby & Cushman

[57] ABSTRACT

Apparatus for sorting ore rocks in which rocks are fed in stream past detector to measure characteristic selected as basis for sorting and into free flight trajectory from which selected individual rocks are deflected according to measure of said characteristic for those rocks. Apparatus is characterized by rock feed means comprising pair of movable elements having surfaces defining upwardly facing nip and which move downwardly at nip to grip rocks and accelerate them downwardly into free flight such that the free flight trajectory is substantially vertical.

The movable elements may be a pair of horizontal rollers having resiliently deformable peripheral surfaces or a pair of flexible endless belts arranged in loops having upper parts defining the nip and, below the nip, adjacent downwardly extending runs between which the rocks are gripped and moved downwardly for some distance below the nip before being projected into vertical free flight.

17 Claims, 7 Drawing Figures

SORTING APPARATUS

BACKGROUND OF THE INVENTION

This invention relates to mechanical sorting systems for sorting objects according to the degree to which they possess a certain characteristic. The invention has particular, but not exclusive, application to ore sorting equipment for sorting ore rocks.

There are various types of ore sorting equipment in which the ore rocks to be sorted are moved in a stream past one or more detectors responsive to a selected characteristic. A decision is made on the suitability of each object by examining the detector output and the object is then accepted or rejected. The detectors may be photometric devices to measure surface characteristic of the rocks or they may measure other characteristics such as radioactivity, electrical resistivity or magnetic permeability.

In conventional ore sorting equipment the rocks are deposited on a fast moving horizontal conveyor belt which moves them in a stream past the detecting or scanning equipment. The rocks are projected from the end of the conveyor in a free flight trajectory and they are either accepted or rejected by being deflected from that trajectory either by a movable deflector plate or by air blasts delivered by a series of blast nozzles.

In some systems the rocks are scanned while in free flight to measure the characteristic to be used as the basis for sorting. In other systems, the rocks pass appropriate detectors while moving on the belt and in this case they may also be scanned while in free flight to obtain a determination of their positions and/or size as additional information which can be used to control the deflection apparatus. In both types of system, the scanning operation is commonly performed by transmission scanners having components located both above and below the rock stream. When dealing with ores contaminated with fine material it is found that the fine material is sprayed from the end of the conveyor belt and falls over the scanning equipment below the main rock stream. This can cause spurious scanning signals and physical damage to the scanning equipment. The present invention provides a sorting apparatus in which objects to be sorted are projected in a downward stream so that the fine material does not tend to separate from the main stream.

Quite apart from the problems caused by stray fine material, it is possible to stabilize ore rocks in a steady spaced apart relationship in a downward stream by means of equipment which can be simpler and considerably cheaper than the conventional equipment for depositing and stabilizing rocks on a fast moving horizontal belt. The invention may also find application in cases where the rocks simply pass an apropriate detector and are not optically scanned.

SUMMARY OF THE INVENTION

According to the invention there is provided sorting apparatus for sorting objects according to the degree to which they possess a certain characteristic, comprising feed means operable to feed objects to be sorted in a stream in which the objects are spaced apart from one another and along a path which comprises a free flight trajectory; means to measure a characteristic of the objects as they move in said stream; and means selectively to deflect individual objects from said free flight trajectory according to the measure of said characteristic obtained for those objects; wherein said feed means comprises a pair of movable elements having surfaces defining an upwardly facing nip, means to feed the objects to be sorted downwardly into said nip and drive means to move said elements such that said surfaces move downwardly at the nip so as to grip the objects and accelerate them downwardly and subsequently to project them downwardly into free flight such that said free flight trajectory is substantially vertical.

The free flight trajectory may be vertical to within 20° and preferably to within 5°.

The means to measure a characteristic of the objects may comprise a photometric scanning device to scan the objects in said free flight trajectory at a location upstream from the deflector means. Alternatively, or in addition, this means may comprise one or more devices for measuring radioactivity, electrical resistivity or magnetic permeability of the objects.

Said elements may comprise a pair of generally horizontal rollers having resiliently deformable peripheral surfaces which can mould themselves about the object at the nip so as to provide a positive gripping action on the objects and so as to accommodate a range of object sizes and shapes. Such rollers may each be formed as a series of discs of rubber or compliant plastic material mounted on a central shaft and bonded or keyed to the shaft.

The apparatus may be such that the rollers project the objects into the free flight trajectory from the nip between them.

In an alternative arrangement, said elements may comprise a pair of flexible endless belts arranged in adjacent endless loops having upper parts defining the nip and, below the nip, adjacent downwardly extending runs between which the objects are gripped and moved downwardly or some distance below the nip before being projected into said free flight trajectory. In this case, the belts may be supported at the nip on a pair of generally horizontal rollers and at least one of the rollers may have a resiliently deformable peripheral surface which can deform to enable the respective belt to mould itself about the objects. Such roller may be formed of a series of discs of rubber or compliant plastic material mounted on a central shaft and bonded or keyed to that shaft.

BRIEF DESCRIPTION OF DRAWINGS

In order that the invention may be more fully explained, several specific embodiments will be described with reference to the accompanying drawings in which.

DESCRIPTION OF PREFERRED EMBODIMENTS

Figure 1:
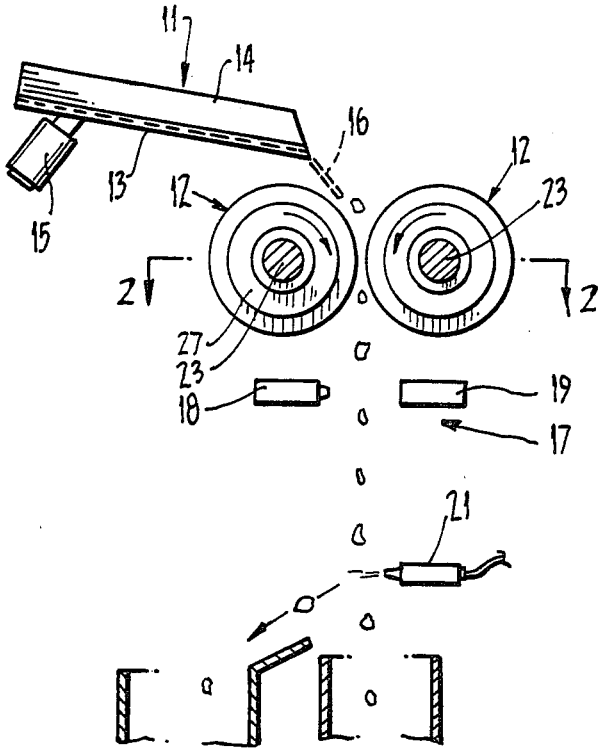
FIG. 1 is a diagrammatic elevation of one type of sorting apparatus constructed in accordance with the invention.
Figure 2:
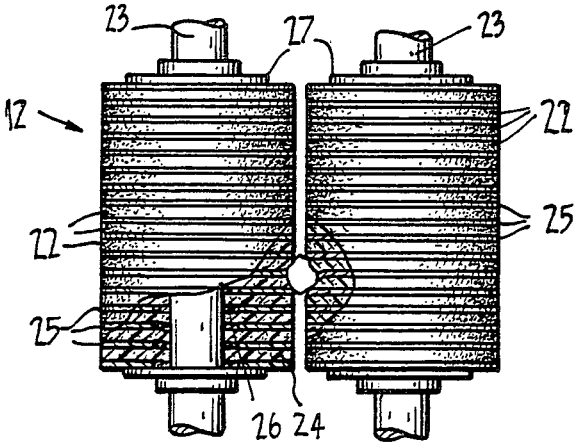
FIG. 2 is a cross-section on the line 2—2 in FIG. 1.

In the apparatus illustrated in FIGS. 1 and 2, the ore rocks to be sorted are fed from a vibratory feeder 11 into an upwardly facing nip defined between a pair of horizontal feed rollers 12 which are counter-rotated at equal speeds so as to grip the rocks and project them downwardly.

Vibratory feeder 11 is of conventional construction. It comprises an inclined tray 13 fitted with side plates 14 and connected to an electrically operable vibrator 15. The tray may be formed with a series of laterally spaced corrugations or grooves to define channels into which the rocks seperate as they slide down the tray. The rocks will then leave the tray in a series of laterally spaced individual streams. These streams may simply fall from the front edge of the tray in free flight trajectories into the nip between feed rollers 12 or, in some cases, a slide plate may be fitted to the front of the vibratory feeder as indicated by the broken lines 16 in FIG. 1.

The rocks may be fed onto the upper end of tray 13 either directly from a hopper or via a first stage vibratory feeder.

The feed rollers 12 act to accelerate the rocks downwardly and to project them into a series of vertical streams in which they are vertically spaced apart.

The vertically falling streams of rocks are scanned by a transmission scanner 17 incorporating a projector 18 and a receiver 19 disposed one to each side of the general plane of the rock streams and after passing through this scanner they approach a horizontal series of air blast nozzles 21.

The signals from the scanner determine the degree to which the individual rocks possess the required characteristic and a decision is made by appropriate electronic equipment as to whether a particular rock is to be accepted or rejected. The accept/reject signals control the operation of the air blast nozzles 21 and the electronic circuitry incorporates an appropriate time delay so that the blast nozzles are actuated at the time that the individual rock reaches the nozzles. Due allowance can be made for the constant acceleration of the rocks due to gravity, which causes a slight increase in their spacing as they fall.

If a particular rock is to be rejected, the appropriate blast nozzle or nozzles produces an air blast which deflects the rock horizontally so that it diverges from its vertical trajectory and falls into a reject bin. Rocks which are to be accepted are not blasted by the nozzles and continue along their vertical trajectory into an accepted rock bin.

Feed rollers 12 must be sufficiently compliant to provide a positive gripping action on rocks of various shapes and sizes without slipping or jamming. For this purpose, each of the feed rollers may be formed as a series of rubber or compliant plastic discs mounted side by side and bonded or keyed to a central driving shaft. This construction is illustrated in FIG. 2 which shows each roller formed by a series of discs 22 mounted on a central shaft 23. The two shafts may be interconnected by appropriate gearing and driven by a single electric drive motor.

Disc 22 may be made from a material comprising closed cell neoprene sponge 24 with a tough skin of neoprene 25 on both sides. The discs are cemented together close to the shaft as indicated by the heavy lines 26 in FIG. 2. The outer margins of the discs abut, but they are free to flex and move independently. This permits the outer peripheral surfaces of the rollers to mould themselves about the rocks and reduces cutting and abrasion due to sharp rocks. The discs are held sandwiched together by end washers 27.

The diameter of feed rollers 12 must be large compared with the dimensions of the rocks to be sorted in order to provide sufficient roller material to flex but they must not be so large that more than one rock can be gripped in any one stream at the same time. A larger diameter roller prevents jamming while a small diameter roller provides clean acceleration of individual rocks one at a time. In addition, the gap between the rollers must be such that the thinnest rock in the size range being handled is positively gripped.

In the apparatus illustrated in FIG. 1, the ore rocks are rapidly stabilized into a stream in which they are spaced apart from one another and capable of being individually scanned. This is achieved by a single pair of feed rollers and the need for extensive belting, belt drives and ancillary equipment is avoided. Moreover, the scanning equipment can be located quite close to the rock stream without being bombarded with fine material since the fine material does not tend to diverge from the main stream.

The sorting apparatus illustrated in FIG. 3 comprises a pair of flexible endless belts 31, 32 arranged in adjacent loops having upper parts defining an upwardly facing nip 33 and, below the nip, adjacent downward runs 34, 35. The upper parts of the belts which define the nip are supported on upper rollers 36, 37 and the lower ends of the belt loops are wrapped around lower rollers 38, 39.

The upper rollers 36, 37 are driven so that the two belts move downwardly at equal speed at the nip and through the adjacent downward runs 32, 33 and the rocks to be sorted are fed downwardly into the nip between the belts by means of a vibratory feeder 41 which may be similar to the feeder 11 of the previous embodiment so as to produce a series of parallel streams of rocks. These streams are accelerated downwardly through the nip and pass vertically between the belt runs 34, 35 which project them into a vertical free flight trajectory.

One or both of the upper rollers 36, 37 may be formed of a series of discs of rubber or compliant plastics material in much the same manner as the feed rollers 12 of the embodiment illustrated in FIGS. 1 and 2. This will permit at least one of the belts to mould itself about the objects to provide a positive gripping action and to accommodate a range of object sizes without jamming.

The free flight streams of rocks may be scanned by a scanner 42 to determine a physical characteristic of the rocks or to determine their positions and rejected rocks may be deflected by air blasts from a series of nozzles 43 as in the previously described embodiment.

Figure 3:
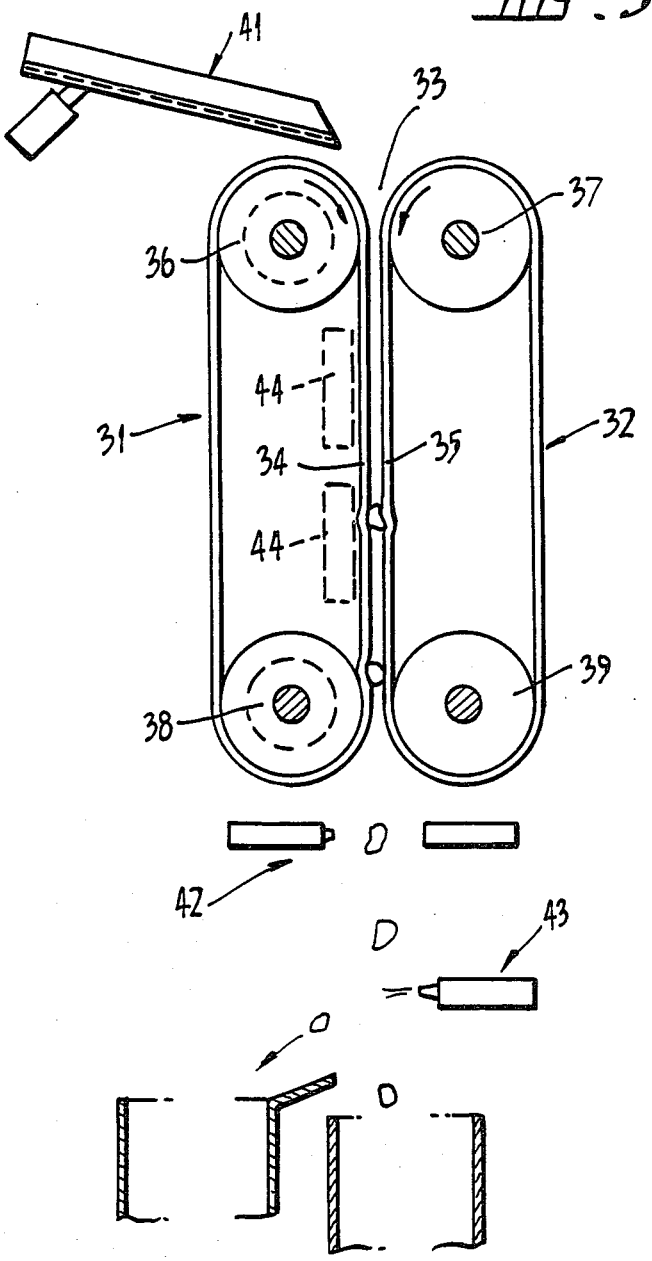
FIG. 3 is a diagrammatic side elevation of an alternative type of sorting apparatus also constructed in accordance with the invention.

In the embodiment illustrated in FIG. 3, the rocks may pass one or more detectors while passing downwardly between the two conveyor belt runs 32, 33. As indicated by the broken lines 44 in FIG. 3, such detectors may be located within one of the belt loops. These detectors may be responsive to the electrical resistivity or magnetic permeability of the rocks or they may be scintillation counters to measure radioactivity of the rocks. The rocks may additionally be scanned while in free flight in order to obtain a measure of their size and/or position for a more accurate determination of their quality and control of the blast nozzles.

FIGS. 4 to 7 illustrate various modifications to the general arrangement of FIG. 3. In the embodiment illustrated in FIG. 4, the two endless belts are indicated as 51, 52 and are shown supported in endless loops on upper rollers 53, 54 and lower rollers 55, 56. Belt 51 encloses a chamber which is pressurized to a pressure indicated as "p" so as to cause the downward run of belt 51 to bulge out and run against the downward run of the other belt 52. The downward run of belt 52 runs over backing rollers 57 and the upward or return run of belt 51 is restrained from bulging out by a further set of backing rollers 58.

Belt 51 may be very pliable and it may be formed as a composite mosaic belt made up of an extremely flexible backing covered by a wear resistant face layer. In operation of this particular embodiment, the pressure "p" supplies a holding force on the rocks and keeps them against the vertical face of belt 52 supported by the rollers 57.

Figure 5:
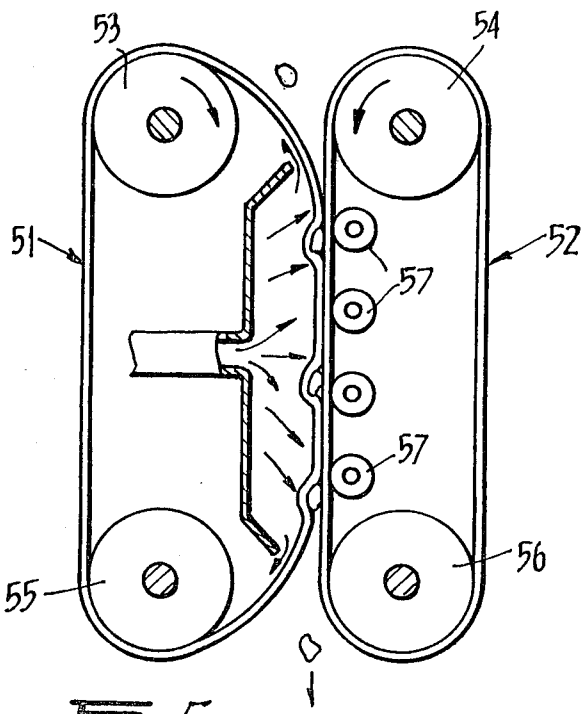
FIGS. 4 to 7 are diagrammatic side elevations of four further alternative forms of sorting apparatus constructed in accordance with the invention.
Figure 4:
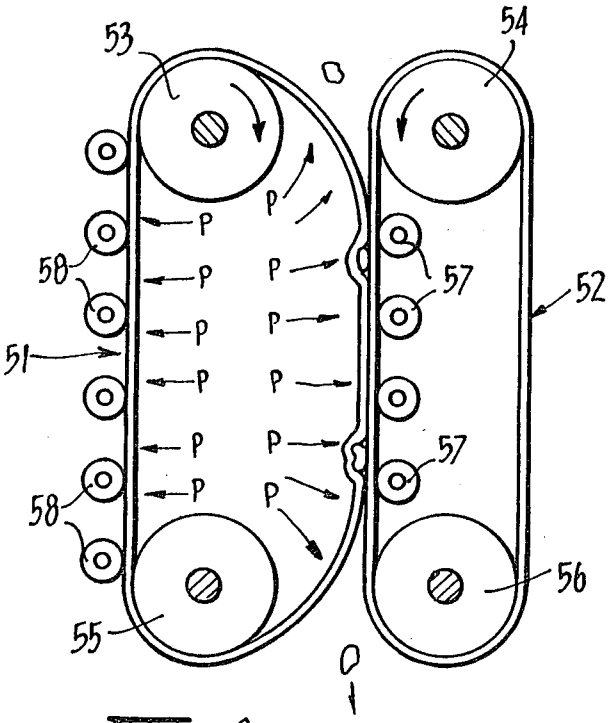

The embodiment illustrated in FIG. 5 is generally similar to that of FIG. 4, but in this case the pressure "p" is applied to the downward run of belt 51 by means of an air discharge duct which discharges air against that part of the belt only. This causes the downward run of belt 51 to bulge out and run against the vertical face of belt 52, the pressure generated by the discharge of air supplying a holding force on the rocks as in the previous embodiment.

Figure 6:
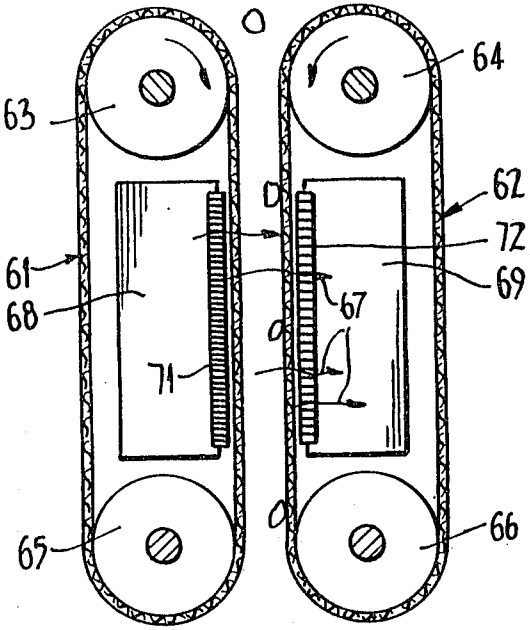

In the embodiment illustrated in FIG. 6, the two endless belts are identified as 61, 62 and are shown mounted on upper rollers 63, 64 and lower rollers 65, 66. The two belts are perforated (they may conveniently be formed of mesh material) and pneumatic means is provided to create a flow of air transversely through the downwardly extending runs of the belts in the direction of arrows 67 to hold the rocks against the downward run of belt 62. The pneumatic means comprises an air discharge duct 68 disposed within the loop of belt 61 and an air extraction or return duct 69 disposed within the loop of belt 62. Air discharge duct 68 has an outlet grille 71 located close to the downward run of belt 61 and the return duct 69 has an inlet grille 72 disposed near to the downward run of belt 62. An air blower or fan (not shown) continuously recirculates air between the discharge duct and the return duct and across the space between the downward runs of the two belts.

Figure 7:
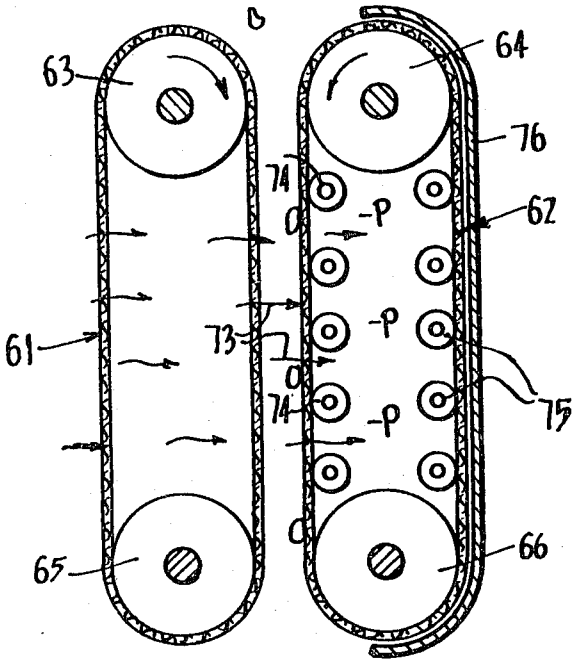

The embodiment illustrated in FIG. 7 is similar to that of FIG. 6 but it employs a different type of pneumatic means. In this case belt 62 encloses a volume to which suction is applied to produce therein a negative (vacuum) pressure indicated as "−p". Air is therefore drawn transversely through the downward runs of the perforated belts as indicated by arrows 73 to hold the rocks against the downward run of belt 62. That run is supported by backing rollers 74 and the upward or return run is supported by backing rollers 75. The upward run of belt 62 runs within a shield 76 which curves around upper roller 64 and lower roller 66 to reduce the suction load required to maintain the negative pressure within the belt.

The illustrated embodiments of the invention have been advanced by way of example only and they could be modified. For instance, the nip of the feed mechanism could be formed between a belt and a roller rather than between two rollers and two belts. It is accordingly to be understood that the invention is in no way limited to the details of the illustrated constructions and that many variations will fall within the scope of the appended claims.

I claim:

1. Sorting apparatus for sorting objects according to the degree to which they possess a certain characteristic, comprising feed means operable to feed objects to be sorted in a stream in which the objects are spaced apart from one another and along a path which comprises a free flight trajectory; means to measure a characteristic of the objects as they move in said stream; and means selectively to deflect individual objects from said free flight trajectory according to the measure of said characteristic obtained for those objects; wherein said feed means comprises a pair of movable elements having surfaces defining an upwardly facing nip, means to feed the objects to be sorted downwardly into said nip and drive means to move said elements such that said surfaces move downwardly at the nip so as to grip the objects and accelerate them downwardly and subsequently to project them downwardly into free flight such that said free flight trajectory is substantially vertical.

2. Sorting apparatus as claimed in claim 1, wherein the free flight trajectory is vertical to within 20°.

3. Sorting apparatus as claimed in claim 2, wherein the free flight trajectory is vertical to within 5°.

4. Sorting apparatus as claimed in claim 1, wherein the means to measure a characteristic of the objects comprises a photometric scanning device to scan the objects in said free flight trajectory at a location upstream from the deflector means.

5. Sorting apparatus as claimed in claim 1, wherein said movable elements comprise a pair of generally horizontal rollers having resiliently deformable peripheral surfaces which can mould themselves about the objects at the nip so as to provide a positive gripping action on the objects and so as to accommodate a range of object sizes and shapes.

6. Sorting apparatus as claimed in claim 5, wherein said rollers are each formed as a series of discs of rubber or compliant plastic material mounted on a central shaft and bonded or keyed to the shaft.

7. Sorting apparatus as claimed in claim 5, wherein the rollers are arranged so as to project the objects into the free flight trajectory from the nip between them.

8. Sorting apparatus as claimed in claim 1, wherein said elements comprise a pair of flexible endless belts arranged in adjacent endless loops having upper parts defining the nip and, below the nip, adjacent downwardly extending runs between which the objects are gripped and moved downwardly for some distance below the nip before being projected into said free flight trajectory.

9. Sorting apparatus as claimed in claim 8, wherein the belts are supported at the nip on a pair of generally horizontal rollers and at least one of the rollers has a resiliently deformable peripheral surface which can deform to enable the respective belt to mould itself about the objects.

10. Sorting apparatus as claimed in claim 8, wherein the belts are supported at the nip on a pair of generally horizontal rollers at least one of which is formed of a series of discs of rubber or compliant plastic material mounted on a central shaft and bonded or keyed to that shaft whereby that roller can deform to enable the respective belt to mould itself about the objects.

11. Sorting apparatus as claimed in claim 8, wherein there is means to apply pneumatic pressure to the downwardly extending run of at least one of the endless belts whereby to press it towards the downwardly extending run of the other endless belt.

12. Sorting apparatus as claimed in claim 8, wherein the two endless belts are perforated and there is pneumatic means operable to create a flow of air transversely through the downwardly extending runs of the belts whereby to urge said objects against one of those belt runs.

13. Sorting apparatus as claimed in claim 8, wherein the two endless belts are perforated and there is pneumatic means operable to create a flow of air transversely through the downwardly extending runs of the belts whereby to urge said objects against one of those belt runs, said pneumatic means comprising an air delivery duct within the loop of one of the belts and an air extraction duct within the loop of the other belt.

14. Sorting apparatus as claimed in claim 8, wherein the two endless belts are perforated and there is pneumatic means operable to apply a suction pressure to the interior side of the downwardly extending run of one of the belts whereby to create a flow of air transversely through that belt run which urges said objects against it.

15. Sorting apparatus as in claim 1 wherein said means to measure a characteristic of the objects includes at least one device for measuring radioactivity.

16. Sorting apparatus as in claim 1 wherein said means to measure a characteristic of the objects includes at least one device for measuring electrical resistivity.

17. Sorting apparatus as in claim 1 wherein said means to measure a characteristic of the objects includes at least one device for measuring magnetic permeability.

* * * * *